US007946264B2

(12) United States Patent
Maehara et al.

(10) Patent No.: US 7,946,264 B2
(45) Date of Patent: May 24, 2011

(54) V-TYPE ENGINE AND MOTORCYCLE INCORPORATING SAME

(75) Inventors: Hayato Maehara, Saitama (JP); Shinji Saito, Saitama (JP); Takaaki Tsukui, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 515 days.

(21) Appl. No.: 12/079,374

(22) Filed: Mar. 26, 2008

(65) Prior Publication Data

US 2008/0236524 A1 Oct. 2, 2008

(30) Foreign Application Priority Data

Mar. 30, 2007 (JP) ..... 2007-095690

(51) Int. Cl.
*F01L 1/34* (2006.01)

(52) U.S. Cl. ..... 123/90.16; 123/90.15; 123/90.48

(58) Field of Classification Search ..... 123/90.15, 123/90.16, 90.48, 90.52
See application file for complete search history.

(56) References Cited

U.S. PATENT DOCUMENTS

| | | | | |
|---|---|---|---|---|
| 6,318,316 | B1 | 11/2001 | Tsukui et al. | |
| 7,131,410 | B2 * | 11/2006 | Kondo et al. | 123/90.17 |
| 7,188,600 | B1 | 3/2007 | Maehara et al. | |
| 7,210,454 | B2 | 5/2007 | Maehara et | |
| 2003/0010301 | A1 * | 1/2003 | Tsukui et al. | 123/90.16 |
| 2003/0075122 | A1 * | 4/2003 | Yamashita | 123/54.5 |
| 2005/0206122 | A1 * | 9/2005 | Ichihara et al. | 280/284 |

FOREIGN PATENT DOCUMENTS

| | | |
|---|---|---|
| JP | 2000-205038 | 7/2000 |
| JP | 2000-303850 | 10/2000 |
| JP | 2002-180812 | 6/2002 |
| JP | 2005-090463 | 4/2005 |
| JP | 2006-283578 | 10/2006 |

* cited by examiner

*Primary Examiner* — Zelalem Eshete
(74) *Attorney, Agent, or Firm* — Carrier Blackman & Associates, P.C.; William D. Blackman; Joseph P. Carrier

(57) ABSTRACT

In a V-type engine for a vehicle, in which a hydraulic valve rest mechanism which selectively holds at least one of an intake valve and an exhaust valve corresponding to a part of plural cylinders in a valve-closed rest state in correspondence with a vehicle running status is provided in a valve actuation unit, and a hydraulic controller which controls hydraulic pressure of the valve rest mechanism is provided in a main engine body, to reduce the distance of oil passage from the hydraulic controller to the hydraulic valve rest mechanism and simplify the structure of the oil passage. A hydraulic controller is provided on at least one side surface of a cylinder head, and may be generally oriented along a line which is substantially parallel to a central axis of a cylinder bore.

17 Claims, 9 Drawing Sheets

V-TYPE ENGINE AND MOTORCYCLE INCORPORATING SAME

CROSS-REFERENCE TO RELATED APPLICATIONS

The present invention claims priority under 35 USC §119 based on Japanese patent application 2007-095690, filed on Mar. 30, 2007. The entire disclosure of this priority document, including specification, claims, and drawings, is incorporated by reference herein.

BACKGROUND OF THE INVENTION

1. Technical Field of the Invention

The present invention relates to a V-type engine, in which intake and exhaust valves are provided in cylinder heads of a front bank and a rear bank cooperating to form a V shape extending in a longitudinal direction of a vehicle, and also to a motorcycle incorporating the engine. More particularly, present invention relates to a V-type engine incorporating a hydraulic valve rest mechanism, that is operable to selectively and temporarily hold one or more of the valves in a valve-closed resting state according to a vehicle running status. The valve rest mechanism is provided in a valve actuation unit, disposed in a valve chamber formed between a cylinder head and a head cover. According to the present invention, a hydraulic controller is provided on the main engine body, for controlling hydraulic pressure of the valve rest mechanism, and this controller is placed in a location closely adjacent to a valve rest mechanism which it controls.

2. Background Art

A vehicle engine, in which a hydraulic controller controls hydraulic pressure of a hydraulic valve rest mechanism provided in a valve actuation unit, so as to set at least one of intake valves and exhaust valves of a part of plural cylinders into a closed state in correspondence with a vehicle running status is generally known (see published patent document JP-A 2002-180812, for example). In the structure disclosed by JP-A 2002-180812, the hydraulic controller is positioned between the V-type structure formed by the front bank and the rear bank of a main engine body. Accordingly, the oil passage from the hydraulic controller to the valve rest mechanism is relatively long and complicated.

SUMMARY OF THE INVENTION

The present invention has been made in view of the above situation, and it is an object hereof to provide a vehicle V-type engine in which the oil passage from the hydraulic controller to the hydraulic valve rest mechanism is shortened, and to thereby simplify the structure of the oil passage.

To attain the above object, a hydraulic controller, for controlling hydraulic pressure supplied to the valve rest mechanism, is provided on at least one of both end side surfaces of the cylinder heads along an axis line of a crankshaft of a vehicle V-type engine having multiple cylinders. Within the engine, intake valves and exhaust valves, individually corresponding to respective cylinders, are provided in cylinder heads of a main engine body with a front bank and a rear bank cooperating to form a V shape extending in a longitudinal direction of a vehicle, and in which a hydraulic valve rest mechanism, that holds at least one of the intake valves and the exhaust valves corresponding to a part of the plurality of cylinders in a valve-closed rest state in correspondence with a vehicle running status, being provided in valve actuation units, accommodated in valve chambers formed between the cylinder heads and head covers connected to the cylinder heads, that selectively operate the intake valves and the exhaust valves.

Further, in a specific embodiment hereof, the hydraulic controller is provided on a side surface of the cylinder head in the rear bank, wherein the width of the rear bank, in a vehicle width direction, is smaller than that of the front bank, so that the hydraulic controller is hidden behind the front bank when the engine is viewed from a vantage point at the front of the vehicle.

Further, in another embodiment of the invention, the main engine body, having the front bank and the rear bank forming a V-shape in the longitudinal direction of the vehicle and spaced apart from each other in the vehicle width direction, has the V-type structure wherein the hydraulic controller is provided on one side surface of the both end side surfaces of the front bank and the rear bank along the axis line of the crankshaft in the cylinder head in one of the front bank and the rear bank, provided inside from the other side surface in the vehicle width direction.

In still another embodiment of the present invention, the main engine body is mounted on a vehicle body frame having a head pipe steerably supporting a front fork and a pair of left and right main frames expanded in the vehicle width direction from the head pipe and extended backward, such that the hydraulic controller is provided inside from the both main frames.

In a first aspect of the invention, the hydraulic controller that controls the hydraulic pressure supplied to the hydraulic valve rest mechanism which is provided in the valve actuation unit accommodated in the valve chamber between the cylinder heads and the head covers, is attached to the cylinder head in which the valve rest mechanism is situated. Because the hydraulic controller is provided near the valve rest mechanism, the oil passage from the hydraulic controller to the valve rest mechanism can be shortened, and the oil passage structure can be simplified. Further, as the hydraulic controller is provided on at least one of the side surfaces of the cylinder heads along the axis line of the crankshaft, the hydraulic controller does not significantly restrict the arrangement of intake pipes and exhaust pipes connected to the cylinder heads.

A second aspect of the invention permits a sideways projection of the hydraulic controller from the engine to be minimized, and therefore, the hydraulic controller is protected in a simple manner. Further, in the second aspect hereof, the hydraulic controller is provided in the cylinder head in the rear bank, with its width in the vehicle width direction smaller than that of the front bank, so as to be hidden behind the front bank, in a front view. Even when the invention is applied to a saddle-type vehicle in which a operator's seat is provided in a position toward the rear of and adjacent to a rear bank, because the hydraulic controller is provided on the side surface of the cylinder head, the influence of the hydraulic controller on a vehicle operator's straddling position can be limited. Further, in another aspect hereof, the hydraulic controller is protected by the main frames, thereby eliminating the requirement for a specialized protection member, and therefore the total number of necessary parts can be reduced.

Hereinafter, working examples of the present invention will be described based on embodiments of the present invention shown in accompanying drawings. The present invention is not limited to the above embodiments, but various design changes can be made without departing from the present invention in the Claims.

For example, in the disclosed embodiments, a 4-cylinder V-type engine has been described, however, the present invention is applicable to other V-type engines such as 2-cylinder, 3-cylinder and 5-cylinder V-type engines.

DETAILED DESCRIPTION

Selected illustrative embodiments of the invention will now be described in some detail, with reference to the drawings. It should be understood that only structures considered necessary for clarifying the present invention are described herein. Other conventional structures, and those of ancillary and auxiliary components of the engine and vehicle, are assumed to be known and understood by those skilled in the art.

Figure 1:
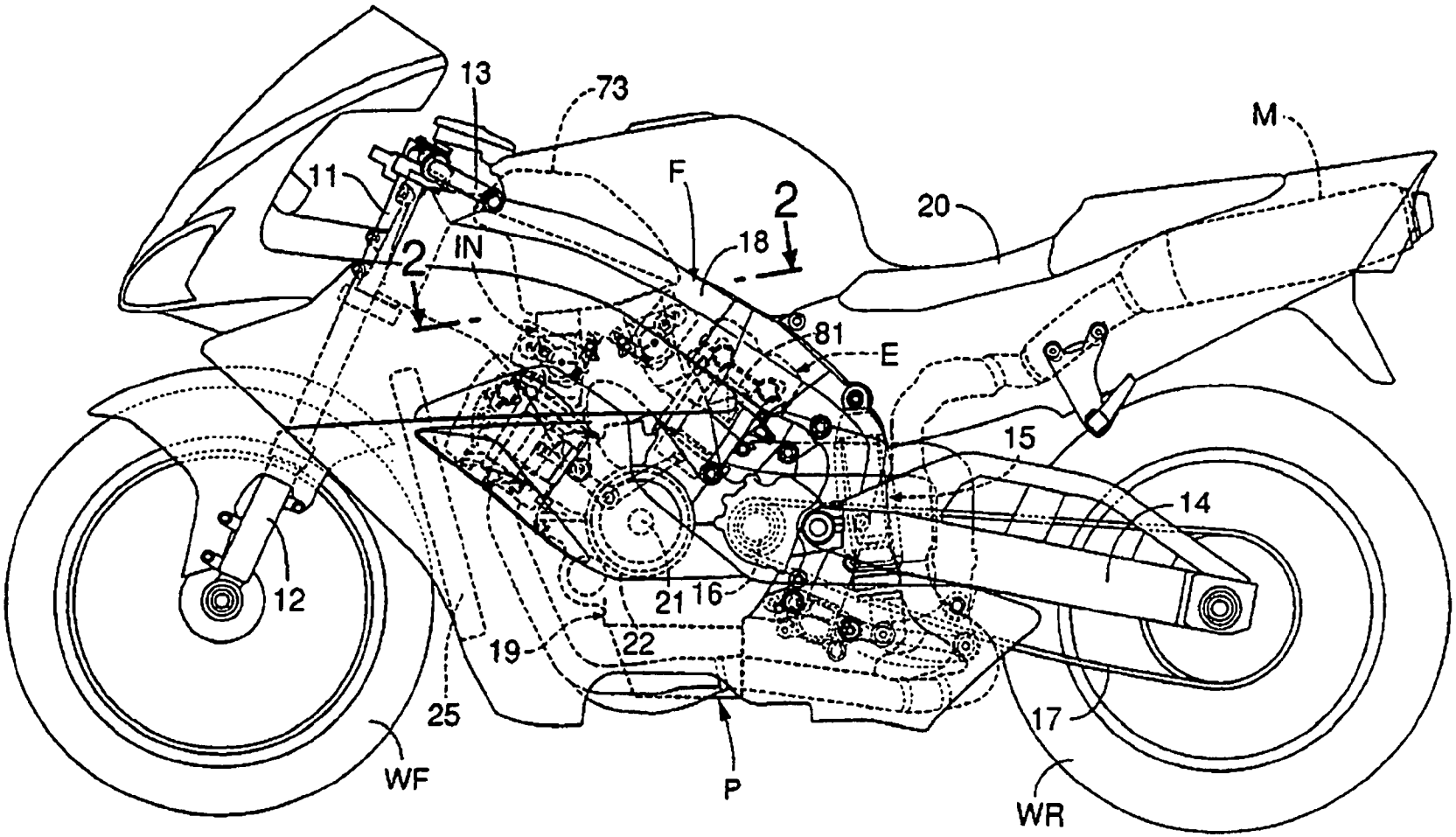
FIG. 1 is a side view of a vehicle incorporating a V-type engine according to a selected illustrative embodiment hereof.

In FIG. 1, in a head pipe 11 at a front end of a vehicle body frame F of a motorcycle a front fork 12 to support a front wheel WF is steerably used. A steering handlebar 13 is coupled to an upper part of the front fork 12. Further, in the vehicle body frame F, a rear fork 14 to support a rear wheel WR is vertically rockably supported. The rear fork 14 is suspended on the vehicle frame F via a suspension member 15.

A power unit P including, for example a 4-cylinder V-type engine E and a transmission (not shown) are mounted on the vehicle body frame F between the front wheel WF and the rear wheel WR. An output shaft 16 of the power unit P is interlocked and coupled with the rear wheel WR via a chain transmission mechanism 17. Further, an operator's seat 20 is provided on the vehicle body frame F in a position behind and above the main engine body 19.

Figure 2:
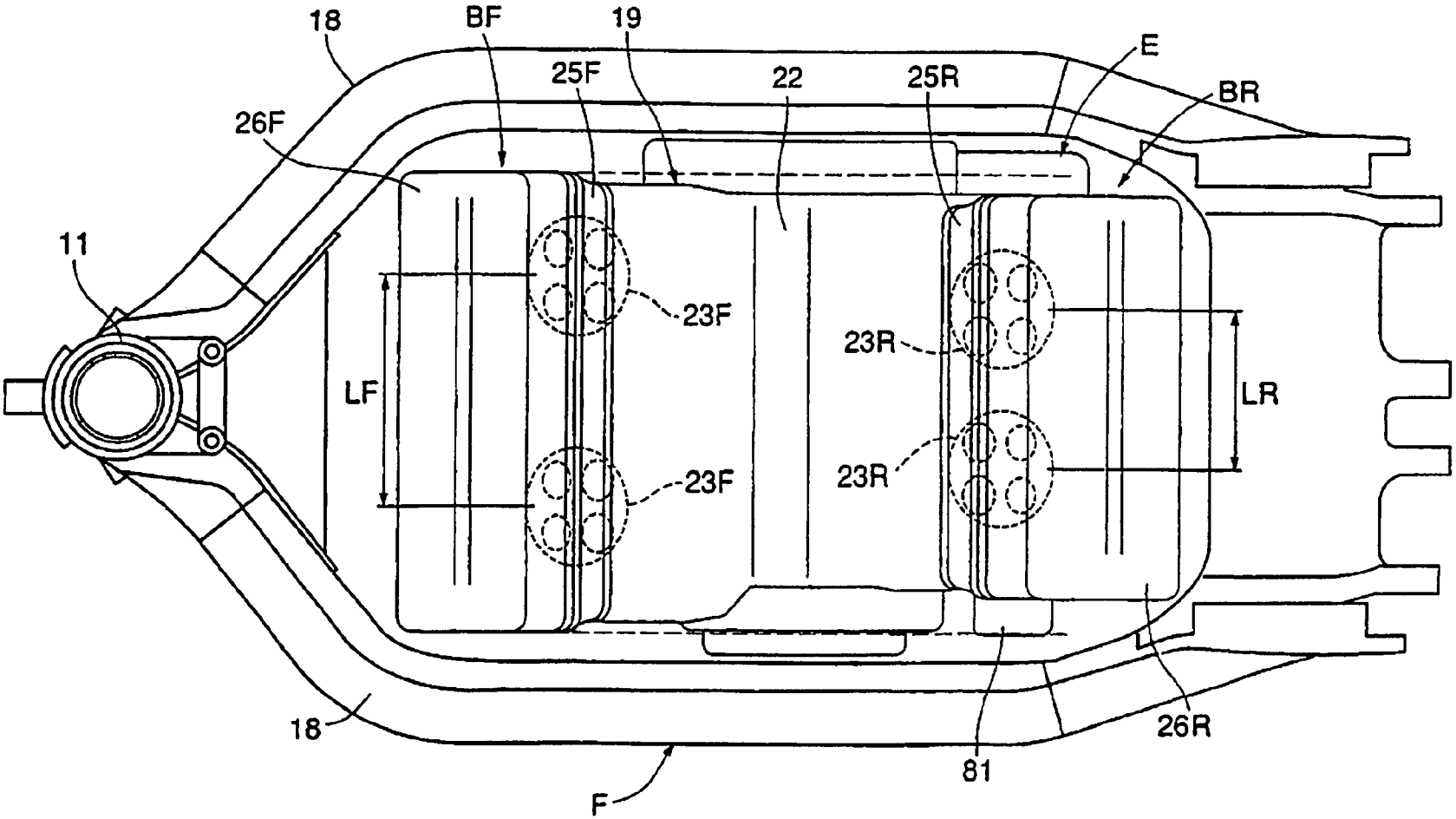
FIG. 2 is a top plan view of the vehicle body frame and the main engine body of FIG. 1, viewed from the 2-2 arrow line direction in FIG. 1.

FIG. 2 depicts the vehicle body frame F having a pair of main frames 18, 18 extending from the head pipe 11 in a vehicle width direction and extending backward while inclining downward. The main engine body 19 of the engine E is provided substantially between the main frames 18.

Figure 3:
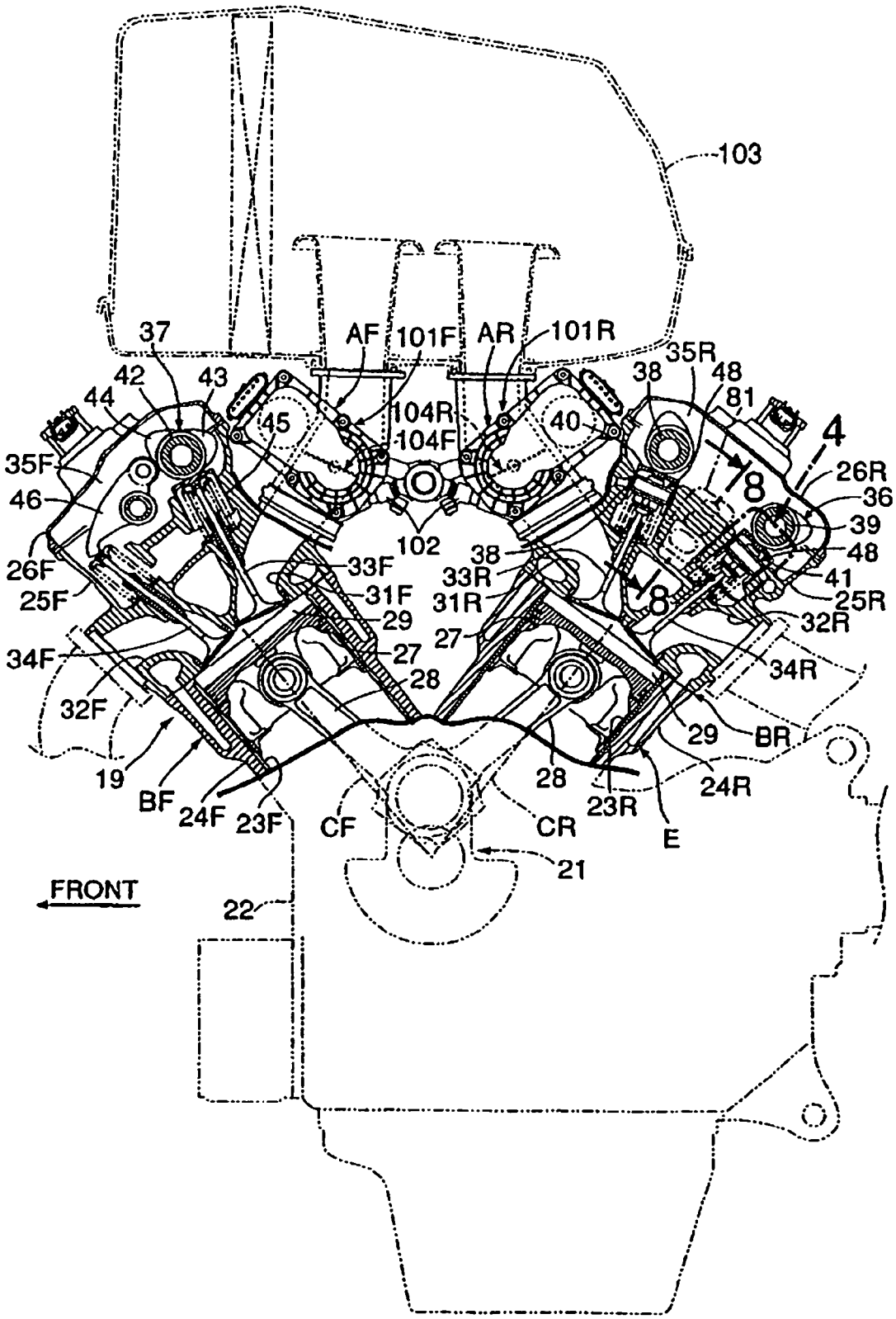
FIG. 3 is a longitudinal cross-sectional view of the main engine body.

FIG. 3 shows the main engine body 19 structured as a V-type having a front bank BF and a rear bank BR being separated in a longitudinal direction of the vehicle, and forming a V shape when viewed from the side. Each of the front and rear banks BF, BR respectively, has two cylinders arranged side-by-side in a horizontal direction of the vehicle body frame F. Lower parts of the front bank BF and the rear bank BR are connected with a shared crankcase 22, rotatably supporting a crankshaft 21 having an axis line extending along the vehicle width direction.

The front bank BF has a cylinder block 24F having a pair of cylinder bores 23F formed therein having a cylinder axis line CF inclined upper-forward, a cylinder head 25F coupled to the cylinder block 24F, and a head cover 26F coupled to the cylinder head 25F. The rear bank BR has a cylinder block 24R having a pair of cylinder bores 23R having a cylinder axis line CR inclined upper-backward, a cylinder head 25R coupled to the cylinder block 24R, and a head cover 26R coupled to the cylinder head 25R. Further, each of the cylinders has an associated piston 27 disposed therein and slidably engaged with the respective cylinder bores 23F, 23R of the front and rear banks BF, BR, and each of the pistons 27 is connected with the crankshaft 21 via an associated connecting rod 28.

As shown in FIG. 2, an interval LF between the central axes of the cylinder bores 23F in the front bank BF is wider than an interval LR between the central axes of the cylinder bores 23R in the rear bank BR. The width of the rear bank BR in a direction along the axis line of the crankshaft 22 is smaller than the width of the front bank BF, such that the rear bank is hidden behind the front bank BF in a front view when the vehicle is viewed from the front. Additionally, a hydraulic controller 81 is mounted on the rear bank BR such that it is hidden behind the front bank BF in a front view when the vehicle is viewed from the front.

Combustion chambers 29, facing tops of the respective pistons 27, are formed in each cylinder between the cylinder blocks 24F, 24R and the associated cylinder heads 25F and 25R. The cylinder head 25F in the front bank BF is provided with intake ports 31F and exhaust ports 32F communicable with the combustion chambers 29. The intake ports 31F are opened in a rear side surface of the cylinder head 25F to face the V-shaped space formed between the front bank BF and the rear bank BR. The exhaust ports 32F are opened in a front side surface of the cylinder head 25F.

Similarly, the cylinder head 25R in the rear bank BR is provided with intake ports 31R and exhaust ports 32R communicable with the combustion chambers 29. The intake ports 31R are opened in a front side surface of the cylinder head 25 to face the V-shaped space. The exhaust ports 32R are opened in a rear side surface of the cylinder head 25R.

A rear valve chamber 35R is formed between the cylinder head 25R and the head cover 26R in the rear bank BR. The rear valve chamber 35R accommodates a first valve actuation unit 36 for selectively opening and closing the intake valves 33R and the exhaust valves 34R provided in the cylinder head 25R for each cylinder of the rear bank.

A front valve chamber 35F is formed between the cylinder head 25F and the head cover 26F in the front bank BF. The front valve chamber 35F accommodates a second valve actuation unit 37 for selectively opening and closing the intake valves 33F and the exhaust valves 34F provided in the cylinder head 25F for each cylinder of the front bank.

The first valve actuation unit 36 includes an intake-side camshaft 38 provided above the intake vales 33R, and an exhaust-side camshaft 39 provided above the exhaust valves 34R. Corresponding to valves 33R and 34R, closed-end cylindrical intake-side valve lifters 40 are slidably engaged with the cylinder head 25R between the intake-side camshaft 38 and the intake valves 33R reciprocate in accordance with rotation of the intake-side camshaft 38.

Additionally, closed-end cylindrical exhaust-side valve lifters 41 are slidably engaged with the cylinder head 25R between the exhaust-side camshaft 39 and the exhaust valves 34R so as to reciprocate in accordance with rotation of the exhaust-side camshaft 39, thus having a double-overhead camshaft structure. Rotational motive power is transmitted in a ½ speed reduction ratio from the crankshaft 21 via a transmission unit (not shown) to the intake-side and the exhaust-side camshafts 38 and 39.

The second valve actuation unit 37 has a single camshaft 42 for the intake valves 33F and the exhaust valves 34F, closed-end cylindrical valve lifters 45 provided between intake-side valve cams 43 provided on the cam shaft 42, intake valves 33F and slidably engaged with the cylinder head 25F, and a rocker arms 46 provided between exhaust-side valve cams 44 and the exhaust valves 34F so as to rock in accordance with the exhaust-side valve cam 44 provided on the camshaft 42. Rotational motive power is transmitted in a ½ speed reduction ratio from the crankshaft 21 via the transmission unit (not shown) to camshaft 42.

The second valve actuation unit 37 always actuates all the cylinders in the front bank BF during running of the engine E. On the other hand, the first valve actuation unit 36 is capable of selectively and temporarily holding at least one of the intake valves 33R and the exhaust valves 34R in a valve-closed rest state and all the cylinders in the rear bank BR in a cylinder-rest state in correspondence with a current operational running status of the engine E. In the present embodiment, in the cylinder rest state, the first valve actuation unit 36 holds both the intake valves 33R and the exhaust valves 34R in the valve-closed rest state.

Further hydraulic valve rest mechanisms 48 are provided in the intake-side and the exhaust-side valve lifters 40, 41 of the first valve actuation unit 36, to allow for selectively and temporarily setting the intake valves 33R and the exhaust valves 34R in the valve-closed rest state.

Figure 4:
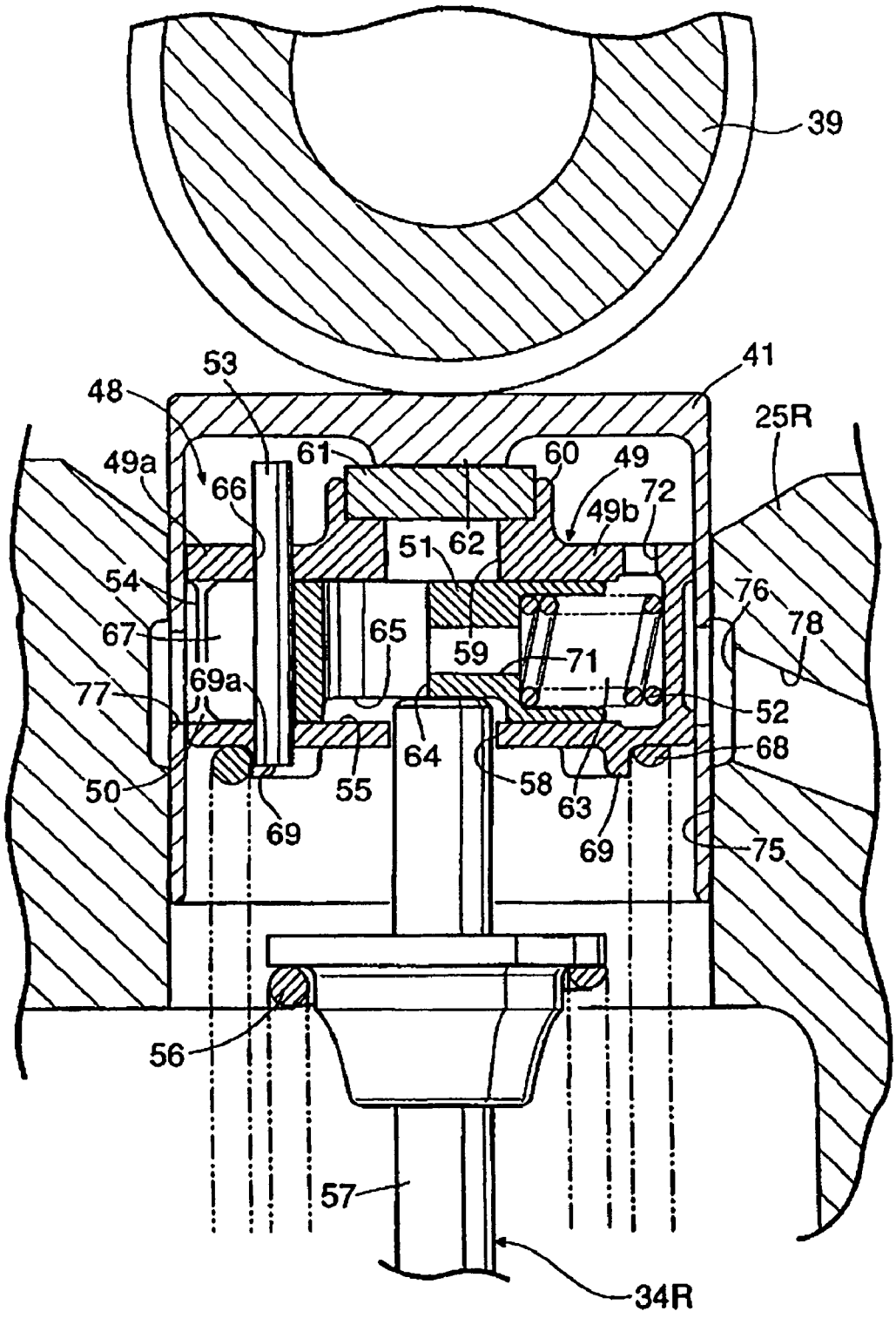
FIG. 4 is an enlarged view of the area denoted by arrow 4 in FIG. 3.

In FIG. 4, the valve rest mechanism 48 provided in the exhaust-side valve lifter 41 has a pin holder 49 slidably engaged with the exhaust-side valve lifter 41, a slide pin 51, forming a hydraulic chamber 50 with respect to an inner surface of the exhaust-side valve lifter 41, slidably engaged with the pin holder 49, a return spring 52, provided between the slide pin 51 and the pin holder 49, to exert a spring force to push the slide pin 51 in a direction to reduce the volume of the hydraulic chamber 50, and a stopper pin 53, provided between the slide pin 51 and the pin holder 49, to regulate a moving end of the slide pin 51 to the side to reduce the volume of the hydraulic chamber 50 while preventing rotation of the slide pin 51 about its axis line.

Figure 5:
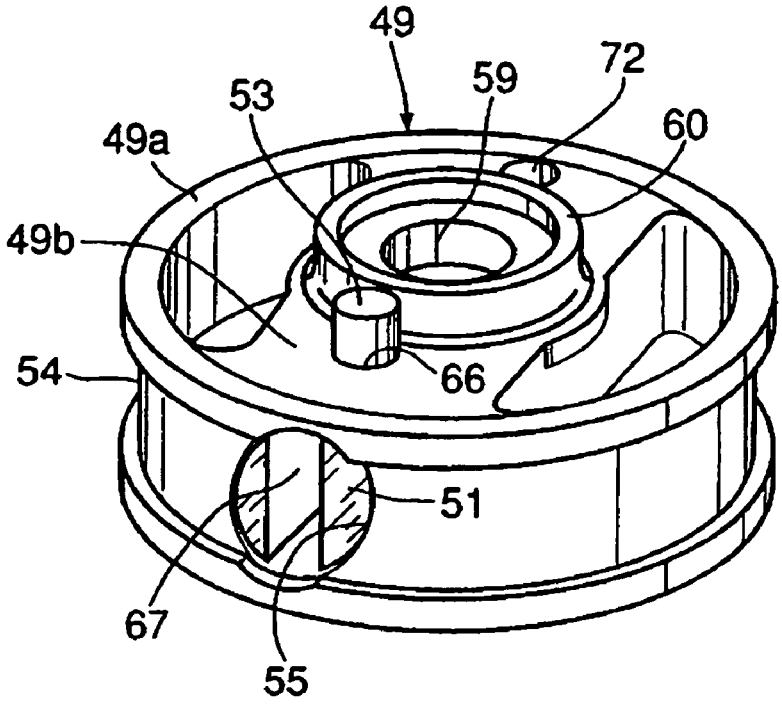
FIG. 5 is a perspective view of the pin holder viewed from an upper direction.
Figure 6:
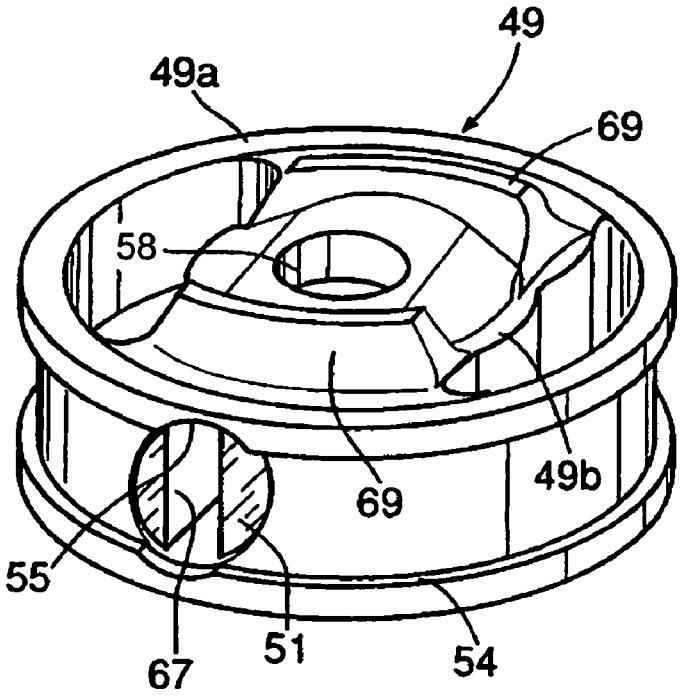
FIG. 6 is a perspective view of the pin holder viewed from a lower direction.

Referring to FIGS. 5 and 6, the pin holder 49 integrally has a ring member 49*a* slidably engaged in the exhaust-side valve lifter 41 and a suspension member 49*b*, along one diametral line of the ring member 49*a*, to connect inner peripheral portions of the ring 49*a*. The inner periphery of the ring member 49*a* and portions between both side surfaces of the suspension member 49*b* are thinned for the purpose of weight saving.

A ring groove 54 is provided in an outer periphery of the pin holder 49 i.e. the outer periphery of the ring member 49*a*. An end-closed slide hole 55, having an axial line orthogonal to an axis line along the one diametral line of the ring member 49 i.e. the axis line of the exhaust-side valve lifter 41, with its one end opened in the ring groove 54 and its other end closed, is provided in the suspension member 49*b* in the pin holder 49. Further, an insertion hole 58, through which an end of a valve stem 57 in the exhaust valve 34R pushed in a valve-closing direction with a valve spring 56 is inserted, is provided such that its inner end is opened in the slide hole 55, in a central lower portion of the suspension member 49*b*. An extended hole 59, in which the end of the valve stem 57 can be accommodated, with the slide hole 55 between the insertion hole 58 and the extended hole 59, is coaxially provided with the insertion hole 58.

Further, a cylindrically-shaped accommodation cylinder 60, coaxial with an axis line of the extended hole 59, is integrally provided in the suspension member 49*b* in the pin holder 49 in a portion of the exhaust-side valve lifter 41 opposite to the closing end. A part of a disk-shaped shim 61 to close an end of the extended hole 59 on the closing end side of the exhaust-side valve lifter 41 is engaged with the accommodation cylinder 60. Further, a projection 62 to contact with the shim 61 is integrally provided in a central portion of an inner surface of the closing end of the exhaust-side valve lifter 41.

The slide pin 51 is slidably engaged with the slide hole 55 of the pin holder 49. The hydraulic chamber 50 communicating with the ring groove 54 is formed between one end of the slide pin 51 and the inner surface of the exhaust-side valve lifter 41. The return spring 52 is accommodated in a spring chamber 63 formed between the other end of the slide pin 51 and a closing end of the slide hole 55.

Figure 7:
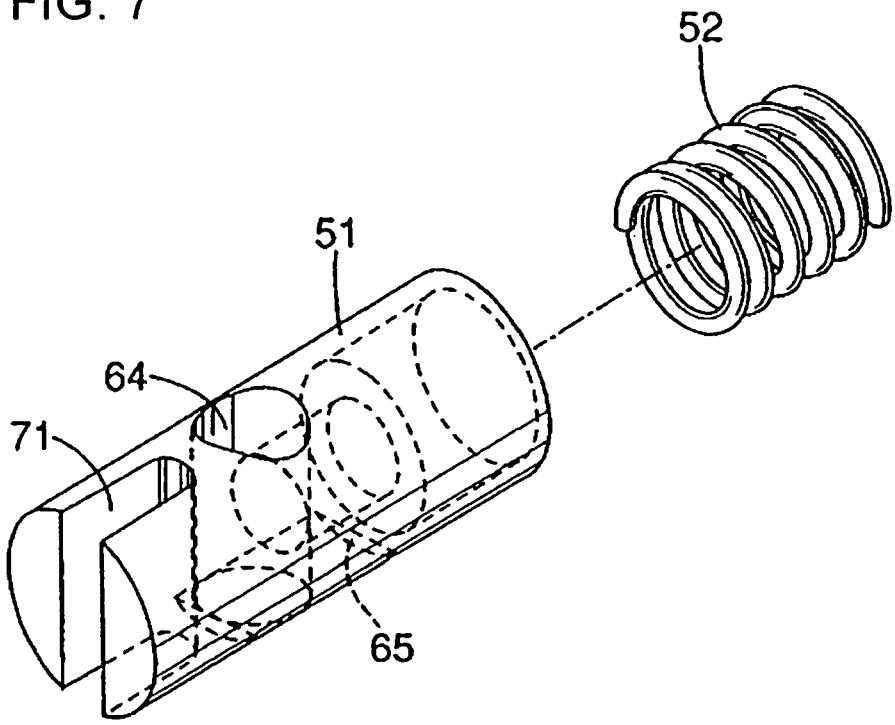
FIG. 7 is a perspective view of the slide pin and the return spring.

Also referring to FIG. 7, an accommodation hole 64 coaxially communicable with the insertion hole 58 and the extended hole 59, in which the end of the valve stem 57 can be accommodated, is provided in a central portion in an axial direction of the slide pin 51. The end of the accommodation hole 64 on the side of the insertion hole 58 is opened in a flat contact surface 65 formed on a lower outer side surface of the slide pin 51 opposite to the insertion hole 58. The contact surface 65 is comparatively long along the axis line direction of the slide pin 51. The accommodation hole 64 is opened in a portion of the contact surface 59 closer to the hydraulic chamber 50.

Such slide pin 51 is slid in the axial direction such that a hydraulic pressure force which acts on one end side of the slide pin 51 by hydraulic pressure of the hydraulic chamber 50 and a spring force which acts on the other end side of the slide pin 51 by the return spring 52 are balanced. In non-operating time where the hydraulic pressure of the hydraulic chamber 50 is low, as shown in FIG. 4, the accommodation hole 64 is shifted from the axis line of the insertion hole 58 and the extended hole 59 and the end of the valve stem 57 is in contact with the contact surface 65. In an operating status where the hydraulic pressure of the hydraulic chamber 50 is high, the end of the valve stem 57 inserted in the insertion hole 58 is moved to the right side in FIG. 4 so as to be accommodated in the accommodation hole 64 and the extended hole 59.

When the slide pin 51 moves to a position where the accommodation hole 64 is coaxially communicated with the insertion hole 58 and the extended hole 59, the pin holder 49 and the slide pin 51 are also moved to the side of the exhaust valve 34R together with the exhaust valve lifter 41 in accordance with sliding of the exhaust-side valve lifter 41 by a pressure force which acts from the exhaust-side camshaft 39. However, only the end of the valve stem 57 is accommodated in the accommodation hole 64 and the extended hole 59 but the pressure force in a valve-opening direction does not act on the exhaust valve 34R from the exhaust valve lifter 41 and the pin holder 49, and the exhaust vale 34R remains closed, i.e., in the suspended state. Further, when the slide pin 51 moves to a position where the end of the valve stem 57 is in contact with the contact surface 65, as the pressure force in the valve-opening direction acts on the exhaust valve 34R in accordance with movement of the pin holder 49 and the slide pin 51 to the side of the exhaust valve 34R corresponding to the sliding of the exhaust-side valve lifter 41 by the pressure force acted from the exhaust-side camshaft 39, the exhaust valve 34R is opened/closed in correspondence with rotation of the exhaust-side camshaft 39.

When the slide pin 51 rotates about its axis line in the pin holder 49, the axis line of the accommodation hole 64 is shifted from that of the insertion hole 58 and the extended hole 59. Further, as the end of the valve stem 57 cannot be brought into contact with the contact surface 65, the rotation of the slide pin 51 about the axis line is prevented with the stopper pin 53.

The stopper pin 53 having an axis line parallel to the axis line of the exhaust-side valve lifter 41 along the one diametral line of the slide hole 55, is attached to an attachment hole 66 coaxially provided in the suspension member 49*b* in the pin holder 49. The stopper pin 53 is inserted through a slit 67 provided on one end side of the slide pin 51 so as to be opened on the side of the hydraulic chamber 50. That is, the stopper pin 53 is attached to the pin holder 49 through the slide pin 51 while allowing movement of the slide pin 51 in its axis line. As the stopper pin 53 is in contact with an inner end closed portion of the slit 67, the moving end of the slide pin 51 to the side of the hydraulic chamber 50 is regulated.

A coil spring 68, which pushes the pin holder 49 to the side where the shim 61 attached to the pin holder 49 is brought into contact with the projection 62 provided in the central portion of the inner surface of the closed end of the exhaust-side valve lifter 41, is provided between the pin holder 49 and the cylinder head 25R so as to surround the valve stem 57 in a position where contact between the outer periphery of the coil spring 68 and the inner surface of the exhaust-side valve lifter 41 is avoided. A pair of projections 69, 69 for positioning of the end of the coil spring 68 in a direction orthogonal to the axis line of the valve stem 57 are integrally provided on the suspension member 49*b* in the pin holder 49. Further, the both projections 69 are integrally provided with the pin holder 49 with a projection amount equal to or less than the wire diameter of the coil spring 68. The projections are formed in arc shape with the axis line of the valve stem 57 as their center. Further, a step member 69*a*, in contact with the end of the stopper pin 53 on the side of the exhaust valve 34R to prevent movement of the stopper pin 53 to the side of the exhaust valve 34R, is formed in one of the both projections 69.

The slide pin 51 is provided with a communicating hole 71 to communicate the spring chamber 63 with the accommodation hole 64 so as to prevent increase/reduction of pressure in the spring chamber 63 by the movement of the slide pin 51 in the axial direction. The pin holder 49 is provided with a communicating hole 72 to communicate space between the pin holder 49 and the exhaust-side valve lifter 41 with the spring chamber 63 so as to prevent change of pressure in the space by temperature change.

The cylinder head 25R is provided with a support hole 75 to be engaged with the exhaust-side valve lifter 41 so as to slidably support the exhaust-side valve lifter 41. The support hole 75 is provided with a ring concave member 76 surrounding the exhaust-side valve lifter 41 in its inner surface. Further, the exhaust-side valve lifter 41 is provided with a communicating hole 77 to communicate the ring concave member 76 with the ring groove 54 of the pin holder 49 regardless of sliding of the valve lifter 41 in the support hole 75. Further, the cylinder head 25R is provided with an oil passage 78 communicating with the ring concave member 76.

The valve rest mechanism 48 is also provided in the intake-side valve lifter 40 as in the case in the exhaust-side valve lifter 41.

The hydraulic pressure in the hydraulic chambers 50 in the hydraulic valve rest mechanisms 48, provided in the first valve actuation unit 36 on the side of the rear bank BR, is controlled by the hydraulic controller 81 provided on the cylinder head 25R in the rear bank BR. The hydraulic controller 81 is provided on a side surface of the cylinder head 25R, and is situated along a line which intersects a longitudinal axis line of the crankshaft 21, as seen in FIG. 3.

In this embodiment, as shown in FIG. 2, the hydraulic controller 81 is provided on a left side surface of the cylinder head 25R in the rear bank BR, in a position inboard of the left side main frame 18, and is oriented substantially along a line which is parallel to a central axis of a cylinder bore formed inside the cylinder head 25R on which the controller 81 is mounted.

Figure 8:
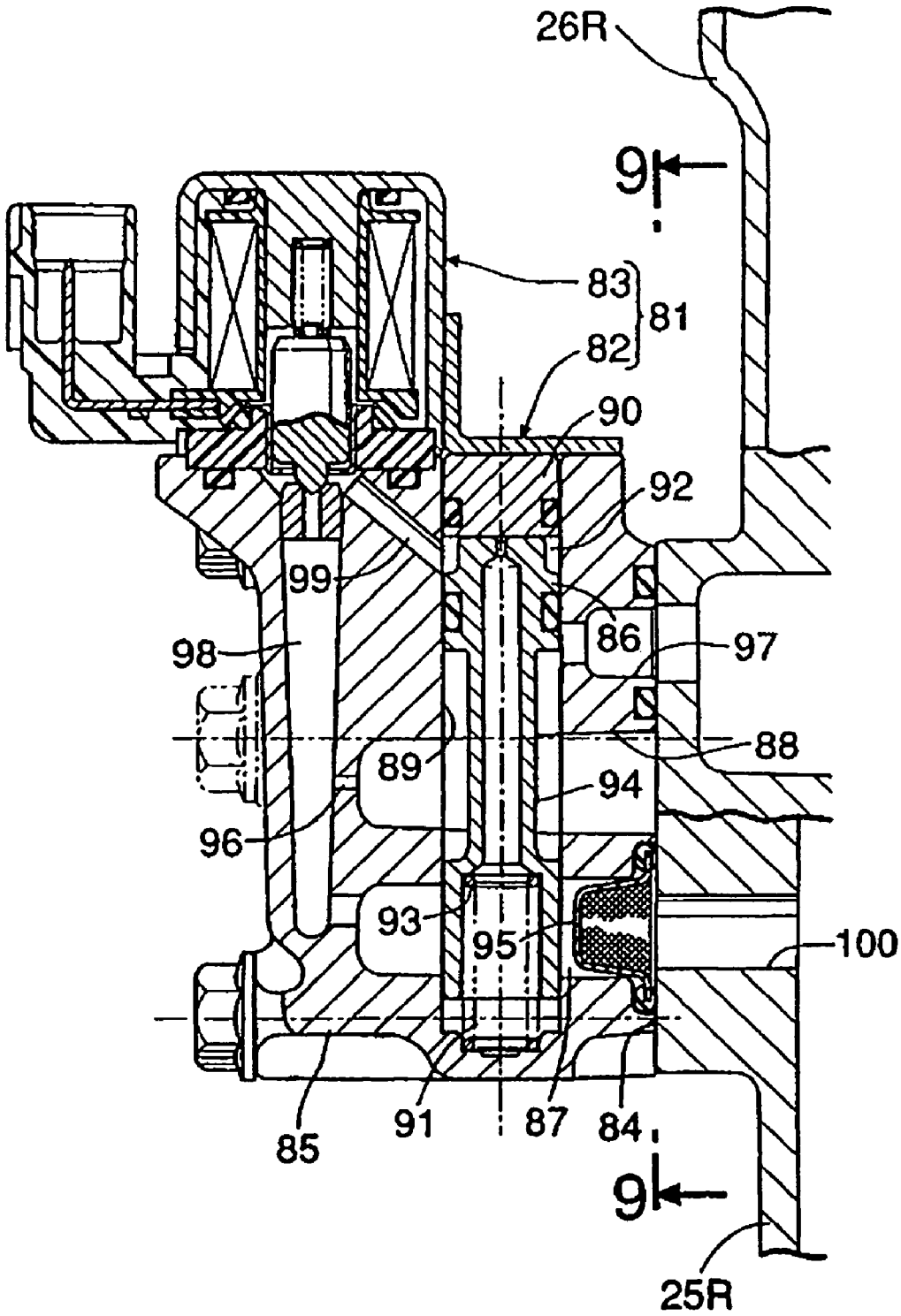
FIG. 8 is a longitudinal cross-sectional view of a hydraulic controller which is a component of the engine, taken along the line 8-8 in FIG. 3.
Figure 9:
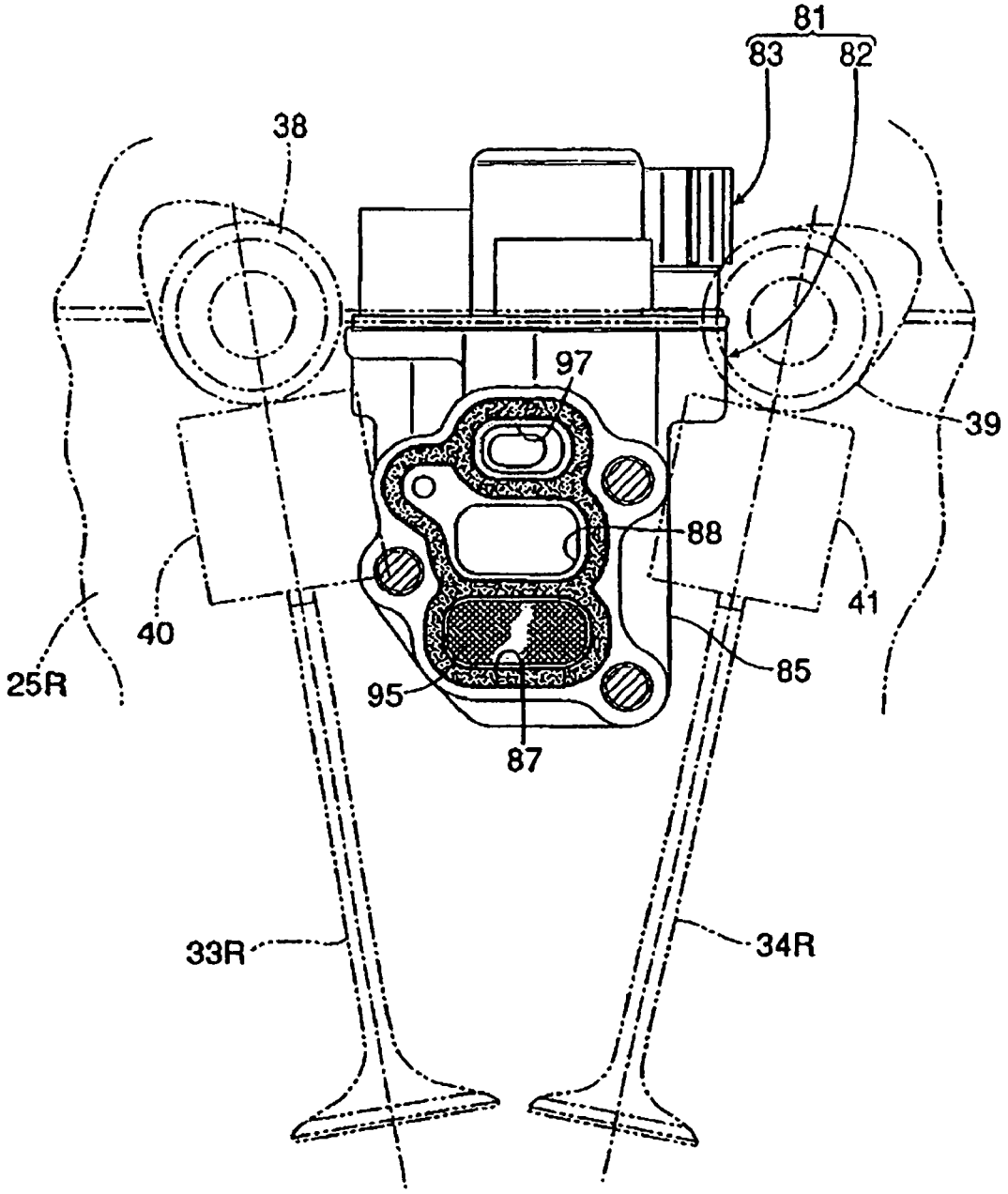
FIG. 9 is a view of the hydraulic controller taken along the arrow line 9-9 in FIG. 8.

In FIGS. 8 and 9, the cylinder head 25R is provided with a flat attachment surface 84 on its left side wall. The hydraulic controllers 81 have a spool valve 82 attached to the attachment surface 84 and an electromagnetic opening/closing valve 83 attached to the spool valve 82.

The spool valve 82 has a valve housing 85, having an inlet port 87 and an outlet port 88 joined to the attachment surface 84, and a spool valve body 86 slidably engaged with the valve housing 85.

The valve housing 85 is provided with an end-closed slide hole 89 with one end closed and the other end opened, and a cap 90 to close the other end opening of the slide hole 89 is engaged with the valve housing 85. Further, the spool valve body 86 is slidably engaged with the slide hole 89. A spring chamber 91 is formed between the spool valve body 86 and the one end close portion of the slide hole 89, and a pilot chamber 92 is formed between the other end of the spool valve body 86 and the cap 90. A spring 93 which pushes the spool valve body 86 to the side to reduce the volume of the pilot chamber 92 is accommodated in the spring chamber 91.

The inlet port 87 and the outlet port 88 are provided in the valve housing 85 so as to be opened in the inner surface of the slide hole 89 in positions sequentially away from one end to the other end side of the slide hole 89 along its axis line. The spool valve body 86 is provided with a ring concave member 94 communicable between the inlet port 87 and the outlet port 88. As shown in FIG. 8, when the spool valve body 86 is moved to a position to reduce the volume of the pilot chamber 92 to a minimum value, the spool valve body 86 functions as a block between the inlet port 87 and the outlet port 88.

An oil filter 95 is attached to the inlet port 87, and an orifice 96 communicating the inlet port 87 with the outlet port 88 is provided in the valve housing 85. Accordingly, even when the spool valve body 86 is in the position to function as a block between the inlet port 87 and the outlet port 88 as shown in FIG. 8, the inlet port 87 and the outlet port 88 communicate with each other via the orifice 96, and hydraulic oil supplied to the inlet port 87 is throttled back with the orifice 96 and flows to the side of the outlet port 88.

Further, the valve housing 85 is provided with a release port 97 which communicates with the outlet port 88 via the ring concave member 94 only when the spool valve body 86 is in a position to function as a block between the inlet port 87 and the outlet port 88. The release port 97 releases the space between the cylinder head 25R and the head cover 26R.

Further, the valve housing 85 is provided with a passage 98 always communicating with the inlet port 87. The passage 98 is connected via an electromagnetic opening/closing valve 83 to a connection hole 99 which communicates with the pilot chamber 92 and is provided in the valve housing 85. Accordingly, when the electromagnetic opening/closing valve 83 is opened, hydraulic pressure is supplied to the pilot chamber 92, and the spool valve body 86 is driven to the side to increase the volume of the pilot chamber 92 by the hydraulic pressure force of the hydraulic pressure introduced in the pilot chamber 92. Then the inlet port 87 and the outlet port 88 communicate with each other via the ring concave member 94 of the spool valve body 86 while the outlet port 88 is blocked from the release port 97.

An oil pump (not shown) to operate in accordance with the crankshaft 21 is accommodated in the crankcase 22. Hydraulic oil supplied from the oil pump is supplied via an oil passage 100 provided in the cylinder head 25R to the inlet port 87 in the hydraulic controller 81.

Further, the oil passage 78 with its one end communicating with the ring concave members 76 in the valve rest mechanisms 48 is provided in the cylinder head 25R, with its other end communicating with the outlet port 88 of the hydraulic controller 81.

When the electronic opening/closing valve 83 of the hydraulic controller 81 opens, the inlet port 87 and the outlet port 88 communicate with each other, and the high hydraulic pressure acts on the hydraulic chambers 50 of the valve rest mechanisms 48. When the valve rest mechanisms 48 operate to cause the intake valves 33R and the exhaust valves 34R into a valve-closed rest state and the electromagnetic opening/closing valve 83 of the hydraulic controller 81 is closed, the communication between the inlet port 87 and the outlet port 88 is broken. When the outlet port 88 communicates with the release port 97, the hydraulic pressure in the hydraulic chamber 50 is released. The slide pins 51 of the valve rest mechanisms 48 are moved to the position to open/close the intake valves 33R and the exhaust valves 34R.

Returning to FIG. 3, in the cylinder head 25F in the front bank BF, throttle bodies 101F are respectively connected with the respective intake ports 31F. In the cylinder head 25R in the rear bank BR, throttle bodies 101R are respectively connected with the intake ports 31R. Fuel injection valves 102, 102 to inject fuel toward the respective intake ports 31F, 31R are respectively attached to the respective throttle bodies 101F, 101R. Further, the throttle bodies 101F on the side of the front bank BF and the throttle body 101R on the side of the rear bank BR are connected in common to an air cleaner 103 provided above these throttle bodies 101F, 101R.

Throttle valves 104F of two throttle bodies 101F on the side of the front bank BF are rotation-controlled at once. A single electric actuator AF for the both throttle bodies 101F is provided in one of the throttle body 101F of the both throttle bodies 101F. On the other hand, throttle valves 104R of the both throttle bodies 101R on the side of the rear bank BR are individually rotation-controlled. Electric actuators AR, AR to control intake amounts for the respective cylinders are individually provided in the both throttle bodies 101R.

Next, an operation of the first embodiment will be described. The first valve actuation unit 36 having a double overhead camshaft structure, in which the intake-side and exhaust-side camshafts 38, 39 individually correspond to the intake valves 33R and the exhaust valves 34R, is accommodated in the valve chamber 35R in the rear bank BR out of the front bank BF and the rear bank BR of the V-shaped main engine body 19. The second valve actuation unit 37 having the common single camshaft 42 for the intake valves 33F and the exhaust valves 34F is accommodated in the valve chamber 35F in the front bank BF.

Accordingly, in the front bank BF on the side where the second valve actuation unit 37 is provided, the cylinder head 25F and the head cover 26F can be downsized. In comparison with a case where the valve actuation units in the front bank BF and the rear bank BR are both have the double overhead camshaft structure, the longitudinal length of the main engine body 19 can be shortened even when the angle between the both banks BF and BR is expanded. This contributes to reduction of the longitudinal length of the vehicle. Further, when the angle between the both banks BF and BR is narrowed, this contributes to downsizing of the vehicle in the vertical direction. Further, as the cylinder head 25F and the head cover 26F in the front bank BF can be downsized, the radiator 25 in front of the main engine body 19 and the front wheel WF can be positioned closer to the rear wheel WR. This contributes to reduction of the longitudinal length of the vehicle.

Further, the first valve actuation unit 36 has the intake-side valve lifters 40 slidably engaged with the cylinder head 25R between the intake valves 33R and the intake-side camshafts 38 so as to reciprocate in accordance with rotation of the intake-side camshaft 38, and the exhaust-side valve lifters 41 slidably engaged with the cylinder head 25R between the exhaust valves 34R and the exhaust-side camshaft 39 so as to reciprocate in accordance with rotation of the exhaust-side camshaft 39. Because the valve rest mechanisms 48 are provided in the intake-side valve lifters 40 and the exhaust-side valve lifters 41, first valve actuation unit 36, the cylinder head 25R and the head cover 26R do not have to be increased in size to accommodate the valve rest mechanisms 48.

Further, as the cylinders in the rear bank BR can be set into the cylinder rest state, the front bank BF where the intake valves 33F and the exhaust valves 34F are always opened/closed is exposed to running wind, thus the cooling of the front bank BF can be improved, and the cooling of the rear bank BR more than necessary in cylinder rest time can be avoided.

Further, the hydraulic controller 81 to control the hydraulic pressure of the valve rest mechanisms 48 is provided in the cylinder head 25R in the rear bank BR, the hydraulic controller 81 is provided near the valve rest mechanisms 48 thereby the oil passage 78 from the hydraulic controller 81 to the valve rest mechanisms 48 can be reduced and the structure of the oil passage can be simplified. Further, because the hydraulic controller 81 is provided at least one of the both end side surfaces of the cylinder head 25R along the axis line of the crankshaft 21, i.e., on the left side surface of the cylinder head 25R in the first embodiment, the hydraulic controller 81 does not influence the arrangement of the intake pipes and the exhaust pipes connected with the cylinder head 25R.

Further, the rear bank BR is smaller than the front bank BF in width in the vehicle width direction so as to be hidden behind the front bank BF. The hydraulic controller 81 is provided on the left side surface of the cylinder head 25R in the rear bank BR. Accordingly, the projection amount of the hydraulic controller 81 from the entire width of the engine E can be decreased and protection of the hydraulic controller 81 can be facilitated. Additionally, although the operator's seat 20 is provided in a position close to the rear bank BR behind the bank, the influence on vehicle operator's straddling position by the hydraulic controller 81 provided on the side surface of the cylinder head 25R can be greatly reduced by reduction of the width of the rear bank BR to a width narrower than that of the front bank BF.

Further, the vehicle body frame F on which the main engine body 19 is mounted has the head pipe 11 steerably supporting the front fork 12 and the pair of left and right main frames 18 expanded in the vehicle width direction from the head pipe 11 and extended backward. As the main engine body 19 is mounted on the vehicle body frame F such that the hydraulic controller 81 is provided inside from the left side main frame 18 of the both main frames 18, the hydraulic controller 81 can be protected with the outside main frame 18. Because a specialized member for protection of the hydraulic controller 81 is unnecessary, the number of parts can be reduced.

Figure 10:
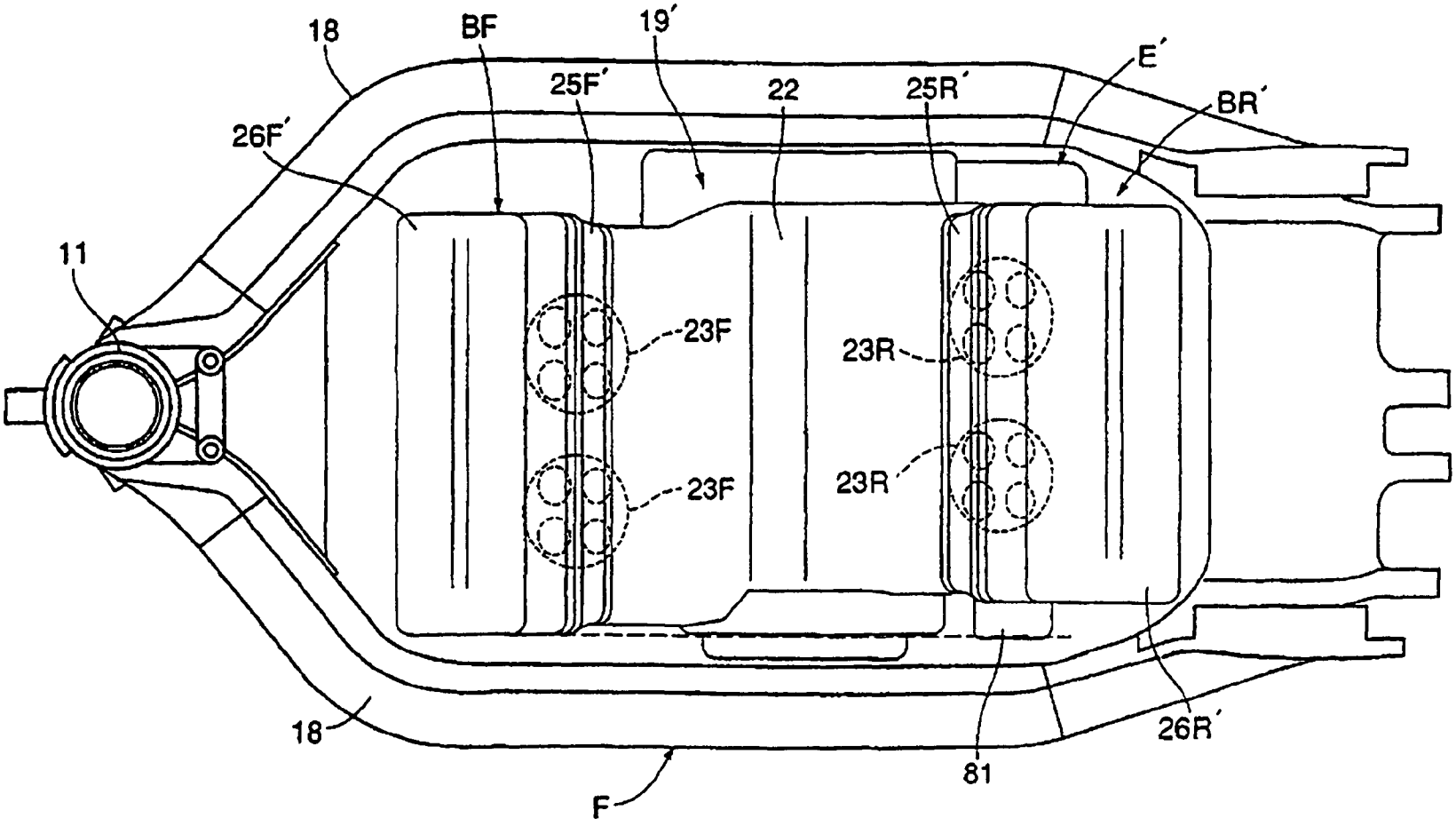
FIG. 10 is a top plan view of the vehicle body frame and the main engine body viewed from the 2-2 arrow line direction in FIG. 1, according to a second embodiment.

FIG. 10 shows a second embodiment of the present invention. A V-type structured main engine body 19' of an engine E' has a front bank BF' having a cylinder head 25F' and a head cover 26F', and a rear bank BR' having a cylinder head 25R' and a head cover 26R'. The front bank BF' and the rear bank BR' are mutually shifted in the vehicle width direction.

Further, the hydraulic controller 81 is provided on the side surface of both end side surfaces of the front bank BF' along the axis line of the crankshaft 21 (first embodiment), provided inside from the side surface in the outermost position in the vehicle width direction, i.e., on the left side surface of the cylinder head 25R' in the second embodiment.

According to the second embodiment, wide projection of the hydraulic controller 81 from the entire width of the engine can be reduced, and protection of the hydraulic controller 81 can be facilitated.

What is claimed is:

1. A V-type engine for a vehicle, said engine comprising:

a main engine body having a front bank and a rear bank cooperating to form a V shape extending in a longitudinal direction of the vehicle, wherein each of said banks comprises:

a cylinder block having two cylinders formed therein, the cylinders of the front bank being spaced farther apart than the cylinders of the rear bank such that a distance between respective central axes of the cylinders of the front bank is wider than a distance between respective central axes of the cylinders of the rear bank, whereby the rear bank is narrower than the front bank;

a cylinder head attached to an upper portion of the cylinder block;

a cylinder head cover attached to an upper portion of the cylinder head, in which a valve chamber is formed between the cylinder head and the cylinder head cover, an intake valve and an exhaust valve slidably disposed in the cylinder head for each of the cylinders;

said engine further comprising a valve-actuating mechanism accommodated in each of said valve chambers for selectively opening and closing one or more of the intake and exhaust valves;

a hydraulically operated valve-pausing mechanism for selectively suspending operation of at least one of the intake valve and the exhaust valve of one or more of the cylinders of the rear bank, depending on an operation state of the engine, such that the at least one of the intake valve and the exhaust valve is temporarily held in a closed state, and a hydraulic pressure control device disposed on the engine for controlling hydraulic pressure supplied to the valve-pausing mechanism, wherein the hydraulic pressure control device is attached to a right or left side surface of the cylinder head of the rear bank proximate said valve-pausing mechanism so as to minimize a length of a hydraulic passage extending therebetween, and wherein said right or left side surface faces outwardly in a vehicle width direction.

2. The engine according to claim 1, wherein the front bank and the rear bank of the main engine body are shifted in a vehicle width direction from a position of alignment with one another, and wherein the hydraulic controller is provided on a side surface of the rear bank, where said side surface is displaced inwardly in a vehicle width direction from a corresponding side surface of the front bank of the engine.

3. The engine according to claim 1, wherein the main engine body is mounted on a vehicle body frame having a head pipe steerably supporting a front fork and a pair of left and right main frames expanded outwardly in the vehicle width direction from the head pipe and extended backward, such that the hydraulic controller is provided between the main frames at a location which is protectively covered by an adjacent one of said main frames.

4. The engine according to claim 2, wherein the main engine body is mounted on a vehicle body frame having a head pipe steerably supporting a front fork and a pair of left and right main frames expanded outwardly in the vehicle width direction from the head pipe and extended backward, such that the hydraulic controller is provided between the main frames at a location which is protectively covered by an adjacent one of said main frames.

5. The engine according to claim 1, wherein the engine further comprises a crankshaft having a longitudinal axis, wherein at least one side surface of the front bank of the main engine body is shifted outwardly in the vehicle width direction in relation to a corresponding side surface of the rear bank, and wherein the hydraulic pressure control device is oriented extending substantially along a line which intersects a longitudinal axis of the crankshaft.

6. The engine according to claim 1, wherein the hydraulic-pressure control device comprises a spool valve and a solenoid valve, wherein the spool valve comprises:

a valve housing having a plurality of passages formed therein including an inlet port, an exhaust port spaced away from the inlet port, and an oil routing passage, and a slide bore having a closed end and which is substantially transverse to a longitudinal axis of the inlet port;

a spool valve body slidably disposed in the slide bore; and a spring disposed in the closed end of the slide bore for biasing the spool valve body in a first direction; wherein said solenoid valve is operable to selectively and temporarily block oil flow through the oil routing passage.

7. A motorcycle comprising the engine of claim 1.

8. A V-type engine for a vehicle, said engine comprising:

a main engine body having a front bank and a rear bank cooperating to form a V shape extending in a longitudinal direction of the vehicle, wherein each of said banks comprises:

a cylinder block having two cylinders formed therein, the cylinders of the front bank being spaced farther apart than the cylinders of the rear bank such that a distance between respective central axes of the cylinders of the front bank is wider than a distance between respective central axes of the cylinders of the rear bank, whereby the rear bank is narrower than the front bank;

a cylinder head attached to an upper portion of the cylinder block;

a cylinder head cover attached to an upper portion of the cylinder head, in which a valve chamber is formed between the cylinder head and the cylinder head cover, an intake valve and an exhaust valve slidably disposed in the cylinder head for each of the cylinders;

said engine further comprising:

a valve-actuating mechanism accommodated in each of said valve chambers for selectively opening and closing one or more of the intake and exhaust valves;

a hydraulically operated valve-pausing mechanism for selectively suspending operation of at least one of the intake valve and the exhaust valve of one or more of the cylinders, depending on an operation state of the engine, such that the at least one of the intake valve and the exhaust valve is temporarily held in a closed state, and a hydraulic pressure control device disposed on the engine for controlling hydraulic pressure supplied to the valve-pausing mechanism, wherein the hydraulic pressure control device is provided on a side surface of one of the cylinder head of the rear bank adjacent a cylinder having said valve-pausing mechanism therein and proximate said valve-pausing mechanism, so as to minimize a length of a hydraulic passage extending therebetween.

9. The engine according to claim 8, wherein the front bank and the rear bank of the main engine body are shifted in a vehicle width direction from a position of alignment with one another, and wherein the hydraulic controller is provided on a side surface of the rear bank, where said side surface is displaced inwardly in a vehicle width direction from a corresponding side surface of the front bank of the engine.

10. The engine according to claim 8, wherein the main engine body is mounted on a vehicle body frame having a head pipe steerably supporting a front fork and a pair of left and right main frames expanded outwardly in the vehicle width direction from the head pipe and extended backward, such that the hydraulic controller is provided between the main frames at a location which is protectively covered by an adjacent one of said main frames.

11. The engine according to claim 8, wherein the engine further comprises a crankshaft having a longitudinal axis, wherein at least one side surface of the front bank of the main engine body is shifted outwardly in the vehicle width direction in relation to a corresponding side surface of the rear bank, and wherein the hydraulic pressure control device is oriented extending substantially along a line which intersects a longitudinal axis of the crankshaft.

12. The engine according to claim 8, wherein the wherein the hydraulic-pressure control device comprises a spool valve and a solenoid valve, wherein the spool valve comprises:

a valve housing having a plurality of passages formed therein including an inlet port, an exhaust port spaced away from the inlet port, and an oil routing passage, and a slide bore having a closed end and which is substantially transverse to a longitudinal axis of the inlet port;

a spool valve body slidably disposed in the slide bore; and a spring disposed in the closed end of the slide bore for biasing the spool valve body in a first direction; wherein said solenoid valve is operable to selectively and temporarily block oil flow through the oil routing passage.

13. A motorcycle comprising the engine of claim 8.

14. A V-type engine for a vehicle, said engine comprising:

a main engine body having a front bank and a rear bank cooperating to form a V shape extending in a longitudinal direction of the vehicle, wherein each of said banks comprises:

a cylinder block having two cylinders formed therein, the cylinders of the front bank being spaced farther apart than the cylinders of the rear bank such that a distance between respective central axes of the cylinders of the front bank is wider than a distance between respective central axes of the cylinders of the rear bank, whereby the rear bank is narrower than the front bank;

a cylinder head attached to an upper portion of the cylinder block;

a cylinder head cover attached to an upper portion of the cylinder head, in which a valve chamber is formed between the cylinder head and the cylinder head cover, an intake valve and an exhaust valve slidably disposed in the cylinder head for each of the cylinders;

said engine further comprising:

a valve-actuating mechanism accommodated in each of said valve chambers for selectively opening and closing one or more of the intake and exhaust valves;

a hydraulically operated valve-pausing mechanism for selectively suspending operation of at least one of the intake valve and the exhaust valve of one or more of the cylinders, depending on an operation state of the engine, such that the at least one of the intake valve and the exhaust valve is temporarily held in a closed state, and a hydraulic pressure control device disposed on the engine for controlling hydraulic pressure supplied to the valve-pausing mechanism, wherein the hydraulic pressure control device is provided on at a side surface of the rear cylinder head adjacent a cylinder having said valve-pausing mechanism therein, wherein the hydraulic-pressure control device comprises a spool valve and a solenoid valve, wherein the spool valve comprises:

a valve housing having a plurality of passages formed therein including an inlet port, an exhaust port spaced away from the inlet port, and an oil routing passage, and a slide bore having a closed end and which is substantially transverse to a longitudinal axis of the inlet port;

a spool valve body slidably disposed in the slide bore; and a spring disposed in the closed end of the slide bore for biasing the spool valve body in a first direction;

wherein the spool valve is movable along an axis of operation which is parallel to a cylinder axis line of a cylinder formed in the cylinder head to which the hydraulic pressure control device is attached and wherein said solenoid valve is operable to selectively and temporarily block oil flow through the oil routing passage.

15. The engine according to claim 14, wherein the front bank and the rear bank of the main engine body are shifted in a vehicle width direction from a position of alignment with one another, and wherein the hydraulic controller is provided on a side surface of the rear bank, where said side surface is displaced inwardly in a vehicle width direction from a corresponding side surface of the front bank of the engine.

16. The engine according to claim 14, wherein the main engine body is mounted on a vehicle body frame having a head pipe steerably supporting a front fork and a pair of left and right main frames expanded outwardly in the vehicle width direction from the head pipe and extended backward, such that the hydraulic controller is provided between the main frames at a location which is protectively covered by an adjacent one of said main frames.

17. A motorcycle comprising the engine of claim 14.

* * * * *